US006427882B1

(12) United States Patent
Harvey

(10) Patent No.: US 6,427,882 B1
(45) Date of Patent: Aug. 6, 2002

(54) COLLAPSIBLE GARMENT HANGER

(76) Inventor: Kevin Harvey, 272 Grandview Cir., Camarillo, CA (US) 93010

( * ) Notice: Subject to any disclaimer, the term of this patent is extended or adjusted under 35 U.S.C. 154(b) by 0 days.

(21) Appl. No.: 09/817,549

(22) Filed: Mar. 26, 2001

(51) Int. Cl.[7] ..... A47G 25/14
(52) U.S. Cl. ..... 223/85; 223/92
(58) Field of Search ..... 223/94, 89, 85, 223/92, 88

(56) References Cited

U.S. PATENT DOCUMENTS

| | | | | | |
|---|---|---|---|---|---|
| 713,376 | A | * | 11/1902 | Baer | 223/94 |
| 2,569,726 | A | * | 10/1951 | McPherson | 223/94 |
| 2,872,090 | A | * | 2/1959 | Goodman | 223/94 |
| 4,673,116 | A | * | 6/1987 | Keller | 223/94 |
| 4,730,757 | A | | 3/1988 | Keller | |
| 4,948,019 | A | * | 8/1990 | Rodum | 223/94 |
| 5,397,037 | A | * | 3/1995 | Ozawa | 223/94 |
| 5,632,422 | A | | 5/1997 | Csengeri | |
| 5,979,721 | A | | 11/1999 | Curtis | |

* cited by examiner

*Primary Examiner*—Bibhu Mohanty
(74) *Attorney, Agent, or Firm*—Winter & Associates; Vision L. Winter

(57) ABSTRACT

The present invention provides for a garment hanging apparatus. The apparatus enables users to hang small-necked garments from a hanger while minimizing stretch damage to the garment. A hook element 100 is provided for supporting the garment hanger from a conventional clothes rod. A base element 102 is interconnected with the hook element 100, and serves as an anchor for the hook element 100. The base element 102 provides a pivotal base for supporting a first pivoting arm 104, and a second pivoting arm 106 which are rotatably joined together at the supporting base 102 by a pin 108.

4 Claims, 5 Drawing Sheets

COLLAPSIBLE GARMENT HANGER

TECHNICAL FIELD

The present invention is generally related to the field of garment hangers, and more specifically to collapsible garment hangers.

BACKGROUND OF THE INVENTION

The necks of garments are sometimes overly stretched and damaged as a result of being removed from and placed on hangers in the conventional manner. The stretching usually occurs because the distance between the hanger arms is greater than the opening of the neck of the garment. To prevent damage, hangers must be separated from the clothing by reaching up through the body of the garment and manipulating the hanger down through the bottom. Or, if the garment is a button type, the necessary number of buttons must be undone before removal. If the article of clothing is removed by manipulating the hanger down through the body of the garment, the hook element is prone to damage the garment, this problem is particularly acute with knitted garments.

Because of the small necks of garments, some garment hanger manufacturers have made the arm-spans short enough to fit inside the neck of garments. The short span of these hanger arms causes the length of the arms to be inadequate for garment shoulder widths. Traditional hanger arms are either too short to adequately support the average garments shoulder length, or to wide to fit through the neck of the garment.

Prior inventions designed to solve the problem of clothes sliding off the hanger and to give adequate support to a garment have been relatively expensive, complicated, have not met with public approval, or have failed to adequately support garments. It is an object of the present invention to provide a garment hanger that overcomes these problems.

SUMMARY OF THE INVENTION

The present invention provides a collapsible clothes hanger wherein the garment supporting elements can be collapsed, such that garments can be removed from, and placed onto the hanger, with relative ease, as compared with traditional hangers. One embodiment of the present invention provides a collapsible garment hanger that includes a base, and a hook interconnected with the base. Further, two arms are provided, and each is connected pivotally at one end to the base. Finally, a spring element is configured to allow the arms to pivotally yield at the base, whereby, small-necked garments may be hung without damaging the garment. As used herein, the term: hang, hung or variants thereof, are understood to include both the hanging and the removal of a garment from a hanger.

In another embodiment of the invention the spring element is at least one helically wound spring. By collapsing the supporting elements the user facilitates the hanging of garments. In yet another embodiment, the undersides of the hanger arms are configured to function as housing for the spring elements. In another embodiment, one of the arms has a wider base on the underside then does the opposing arm, thus allowing the arms to mutually engage each other when the arms are in the collapsed position.

In yet another embodiment the collapsible arms are pivotally interconnected with the at least one spring by a pin that interconnects with the hook element. This pin rotatably joins the arms. The at least one spring arms extend along the underside of the collapsible supporting elements. Preferably the at least one spring is wound around the pin forming a helically wound spring. The at least one spring is configured to urge the collapsible supporting elements away from each other with sufficient force to allow the hanger to support the garment. In a preferred embodiment different colors may be utilized to indicate the appropriate garment weight range for a particular hanger.

BRIEF DESCRIPTION OF THE DRAWINGS

The objects, features, and advantages of the present invention will be apparent from the following detailed description of the preferred embodiment of the invention with references to the following drawings.

DETAILED DESCRIPTION

The present invention is generally related to garment hangers, and more specifically to collapsible garment hangers. The following description, taken in conjunction with the referenced drawings, is presented to enable one of ordinary skill in the art to make and use the invention and to incorporate it in the context of particular applications. Various modifications, as well as a variety of uses in different applications, will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein. Furthermore it should be noted that unless explicitly stated otherwise, the figures included herein are illustrated diagrammatically and without any specific scale, as they are provided as qualitative illustrations of the concept of the present invention.

Figure 1:
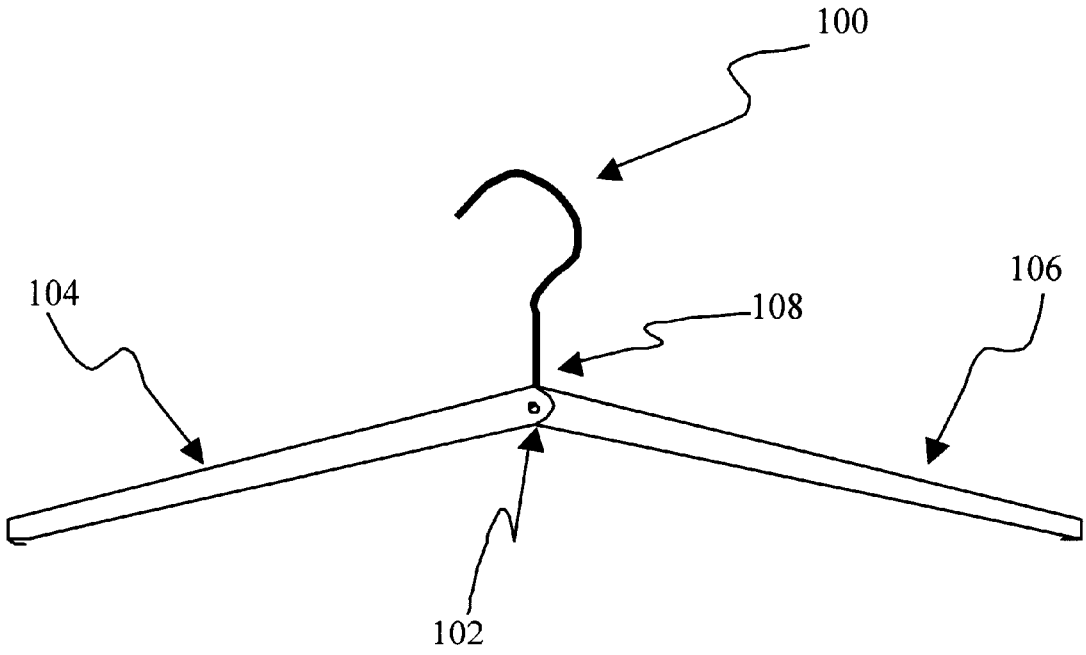
FIG. 1 is a side view of one embodiment of the present invention showing the position of the hanger in its open, unfolded position.

The present invention provides for a garment hanging apparatus. The apparatus enables users to hang small-necked garments from a hanger without causing stretch damage to the garment. One embodiment of the present invention, is set forth in FIG. 1, where a side view of the garment hanger in its open position is presented. A hook element 100 is provided for supporting the garment hanger from a conventional clothes rod. A base element 102 is interconnected with the hook element 100, and serves as an anchor for the hook element 100. The base element 102 provides a pivotal base for supporting a first pivoting arm 104, and a second pivoting arm 106 which are rotatably joined together at the supporting base 102 by a pin 108. In some situations the base and the pin may be the same. This is not depicted herein.

Figure 2:
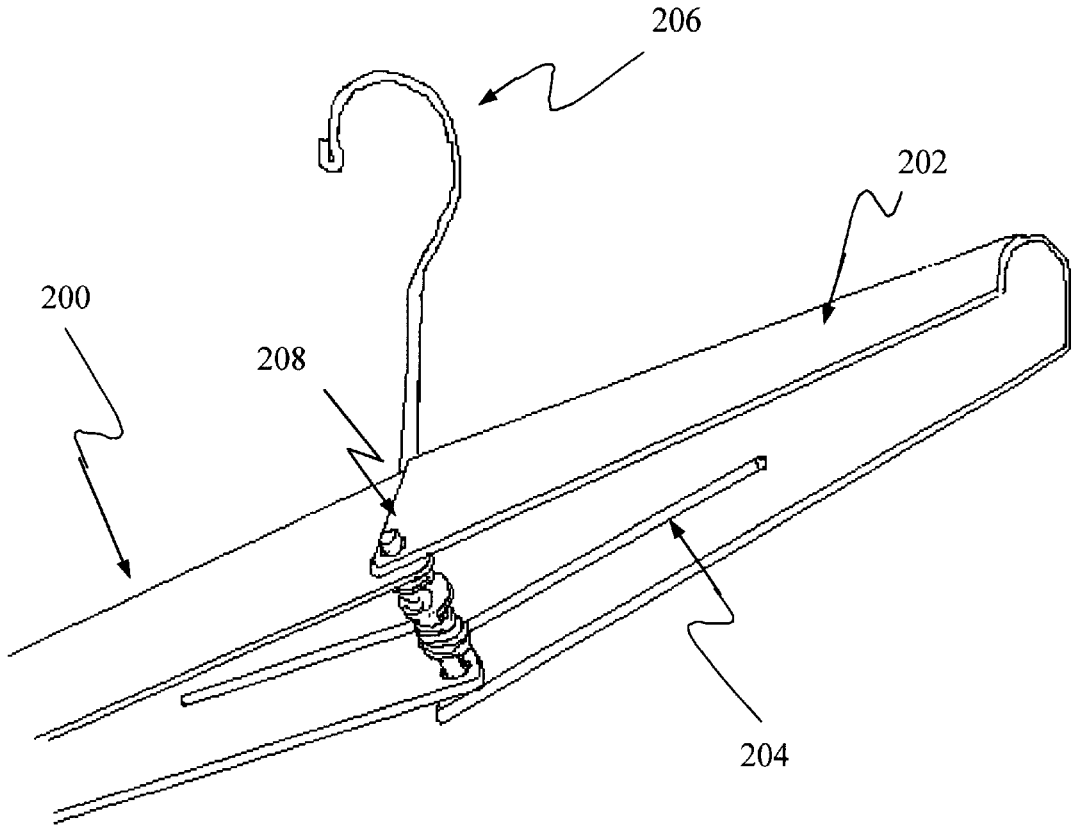
FIG. 2 is a fragmented perspective view, partly in section, illustrating the spring elements of one embodiment of the present invention.

Another embodiment of the present invention is set forth in FIG. 2, where the elastically deformable elements of the garment hanger are visible. The view shows the underside of the first supporting arm 200 and the underside of the second supporting arm 202 and how they interrelate to form a housing for a spring element 204. A support pin 208 extends through the sides of the first supporting arm 200 and the second supporting arm 202. The pin 208 serves as an anchor supporting the interconnectivity between the spring element 204, the first supporting arm 200, the second supporting arm 202, and the hook element 206. The first supporting arm 200 and the second supporting arm 202 pivot on the pin 208. The spring element 204 extends along the underside of the first supporting arm 200 and the second supporting arm 202. The spring element 204 is preferably wound about the pin 208 and housed by the first supporting arm 200 and the second supporting arm 202. The spring element 204 is configured yield when pressure exceeding a predefined limit is reached, thus forcing the first supporting arm 200 and the second supporting arm 202 to come together when the predefined pressure is achieved. When the pressure is reduced to a level below the predefined level, the spring element 204 will force the first supporting arm 200 and the second supporting arm 202 away from each other, and the garment hanger will return to its original configuration, and support garments. The first supporting arm 200 and the second supporting arm 202 are prohibited from rising beyond a predetermined level by the hook element 206. In practice, a user would apply a force-causing deformation to the first supporting arm 200 and the second supporting arm 202 and as the arms yield to the pressure the hanger arms will rotate and collapse towards each other to release the garment. When the force causing deformation is removed supporting elements will return to a substantially horizontal position.

Figure 3:
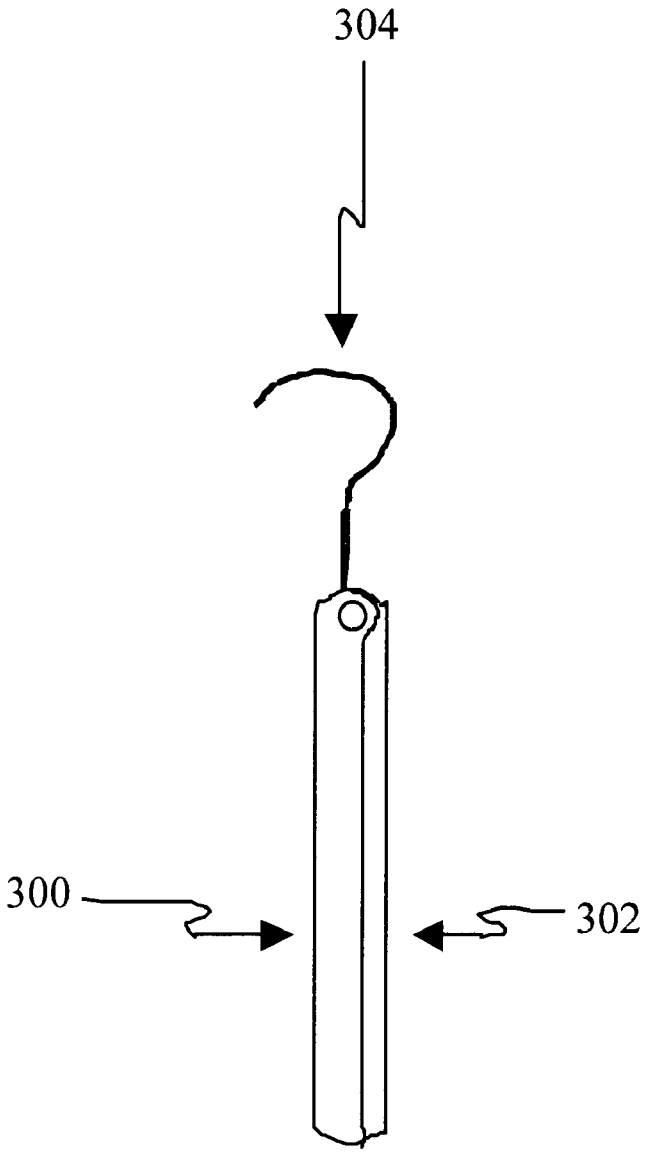
FIG. 3 is a side view of one embodiment of the present invention showing the position of the hanger in its collapsed position, with the collapsible supporting elements in a substantially vertical position.

In FIG. 3 the first collapsible element 300 has a wider base on the underside than does the second collapsible element 302 thus allowing the elements to mutually engage each other when the elements are collapsed. This feature is especially desirable for transporting the garment hanger. In the collapsed state the garment hanger can be transported with ease even in relatively small spaces. In another embodiment the hook 304 is made of a non-rigid material that can be looped over a clothes rod and serve as the hanger support. Such non-rigid support could include a Velcro strap. Further, the hanger arms could be configured to telescope and thus serve to make the hanger arms adjustable. In another embodiment of the present invention the hanger arms are color coded to reflect the force needed to collapse the springs. For example, red could have springs for light shirts and blue could be for heavy garments and the color range in-between could be used for garments in the mid-range of weight. In another embodiment of the present invention the spring element could be made from at least one resilient spring element, such as at least one piece of steel or other element pre-disposed to keeping the supporting elements in a substantially horizontal position.

Figure 4A:
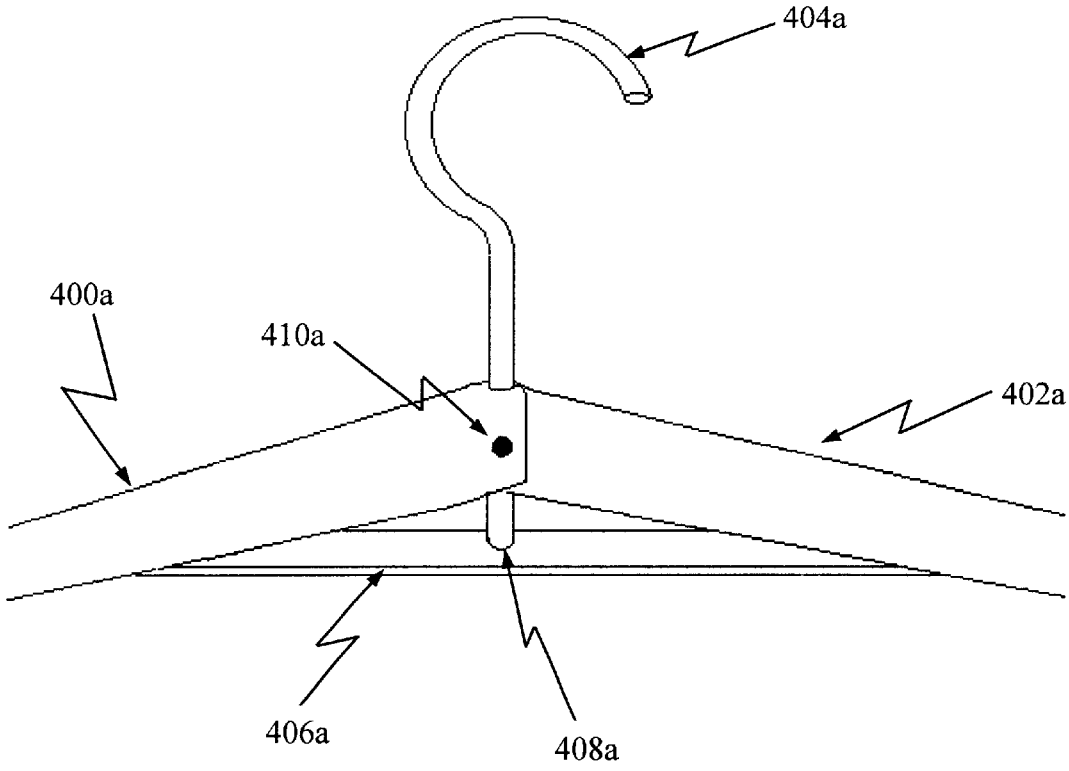
FIG. 4*a* is a view of one embodiment of the present invention wherein the spring element is an elastically deformable strip of metal.
Figure 4B:
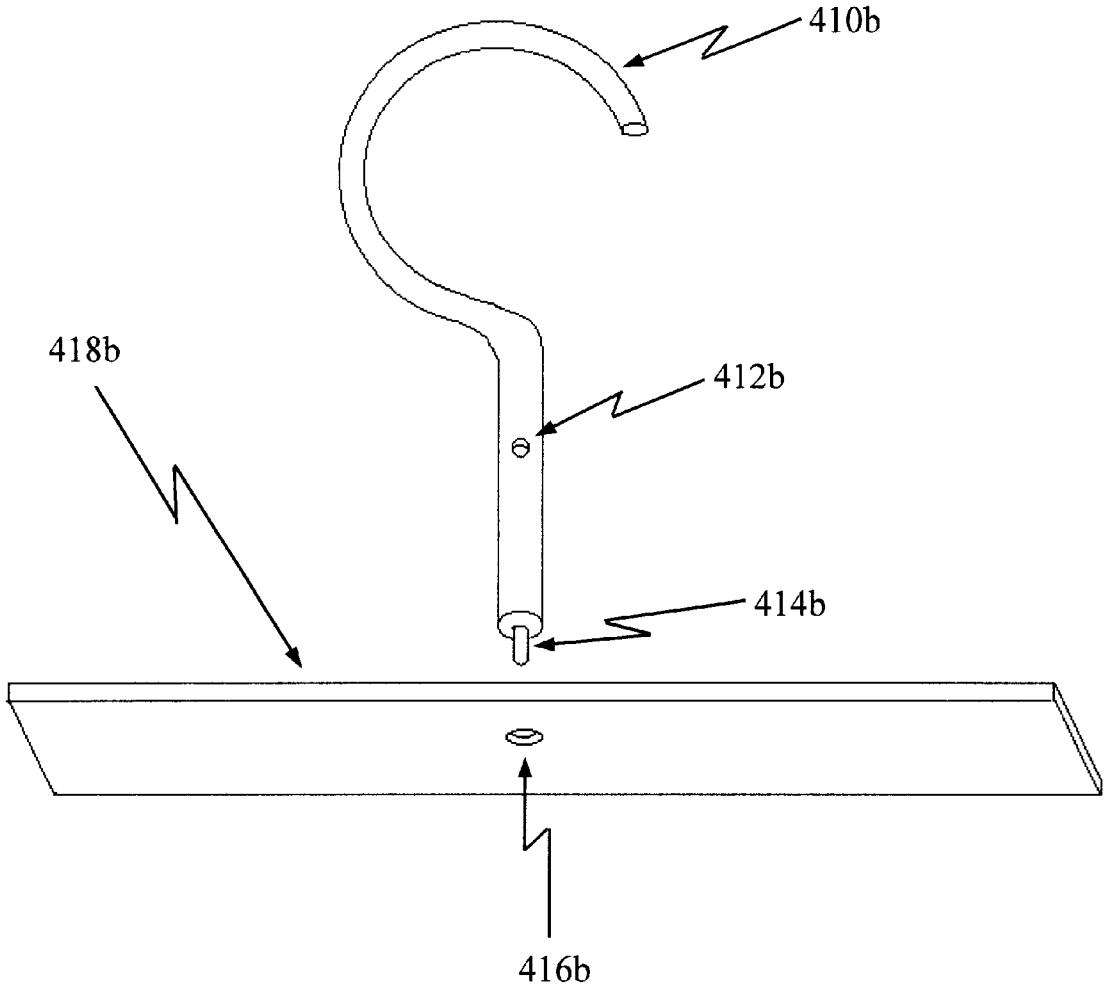
FIG. 4*b* is a detailed view of one embodiment showing the elastically deformable spring element.

Yet another embodiment is set forth in FIG. 4*a,* where the first supporting arm 400*a* and the second supporting arm 402*a* are interfaced with the base element and the hook element 404*a*. In this drawing the hook element serves as the base element. Further, the resilient spring element 406*a* is attached to the bottom side 408*a* of the hook element 404*a*. In FIG. 4*b* the interrelationship between the various parts is further elucidated. The hook element 410*b* has a hole 412*b* configured to accept a pivot pin. Additionally, the hook element 410*b* has a pin 414*b* at its bottom side. The resilient spring element 418*b* has a hole 416*b* in its middle and is placed over the pin 414*b*. The spring element 418*b* is made secure to the hook element 410*b* by means of compacting or applying solder to the head of the pin 414*b*.

What is claimed is:

1. A collapsible garment hanger comprising:

a base;

a hook interconnected with said base;

two arms, wherein each arm is connected pivotally at one end to the base; and at least one spring element configured to allow the arms to pivotally yield at the base;

wherein the arms are color coded to represent the pressure at which the arms yield; and whereby small necked garments may be hung without damaging the garment.

2. A collapsible garment hanger as set forth in claim 1, wherein the arms are telescoping.

3. A collapsible garment hanger, as set forth in claim 1, wherein the hook is a non-rigid material.

4. A collapsible garment hanger as set forth in claim 2, wherein the hook is a non-rigid material.

* * * * *